United States Patent [19]

Futamase et al.

[11] Patent Number: 4,569,268

[45] Date of Patent: Feb. 11, 1986

[54] MODULATION EFFECT DEVICE FOR USE IN ELECTRONIC MUSICAL INSTRUMENT

[75] Inventors: Tsuyoshi Futamase; Mitsumi Kato, both of Hamamatsu, Japan

[73] Assignee: Nippon Gakki Seizo Kabushiki Kaisha, Japan

[21] Appl. No.: 682,563

[22] Filed: Dec. 14, 1984

Related U.S. Application Data

[63] Continuation of Ser. No. 449,298, Dec. 13, 1982.

[30] Foreign Application Priority Data

Dec. 23, 1981 [JP] Japan ..... 56-208293

[51] Int. Cl.[4] ..... G10H 1/02

[52] U.S. Cl. ..... 84/1.24; 84/DIG. 4; 84/DIG. 26; 381/62; 381/63

[58] Field of Search ..... 84/1.24, 1.25, DIG. 4, 84/DIG. 26; 381/61, 62, 63

[56] References Cited

U.S. PATENT DOCUMENTS

| | | | |
|---|---|---|---|
| 3,749,837 | 7/1973 | Doughty | 84/1.03 X |
| 4,175,464 | 11/1979 | Deutsch | 84/1.24 |
| 4,275,267 | 6/1981 | Kurtin et al. | 84/DIG. 26 |
| 4,389,915 | 6/1983 | Bione | 84/1.24 |
| 4,392,405 | 7/1983 | Franz et al. | 84/1.24 |

*Primary Examiner*—Forester W. Isen

*Attorney, Agent, or Firm*—Remy J. VanOphem

[57] ABSTRACT

A modulation effect device for use in an electronic musical instrument which utilizes, as a digital modulation circuit, a digital memory device for storing digitized musical tone signals. The digital memory device is accessed by modulation coefficient generating means which supplies a modulated address information to the digital memory device to read out from the memory device a musical tone signal modulated in accordance with the modulated address.

8 Claims, 27 Drawing Figures

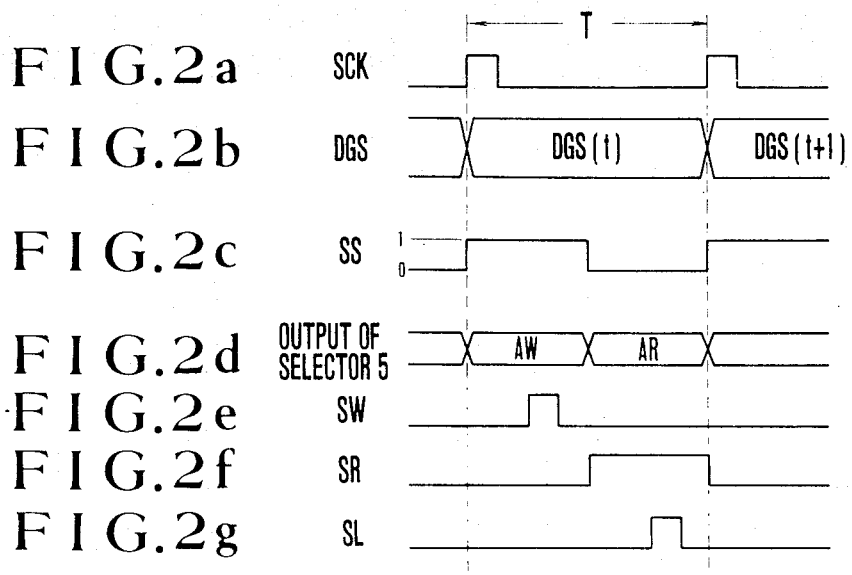
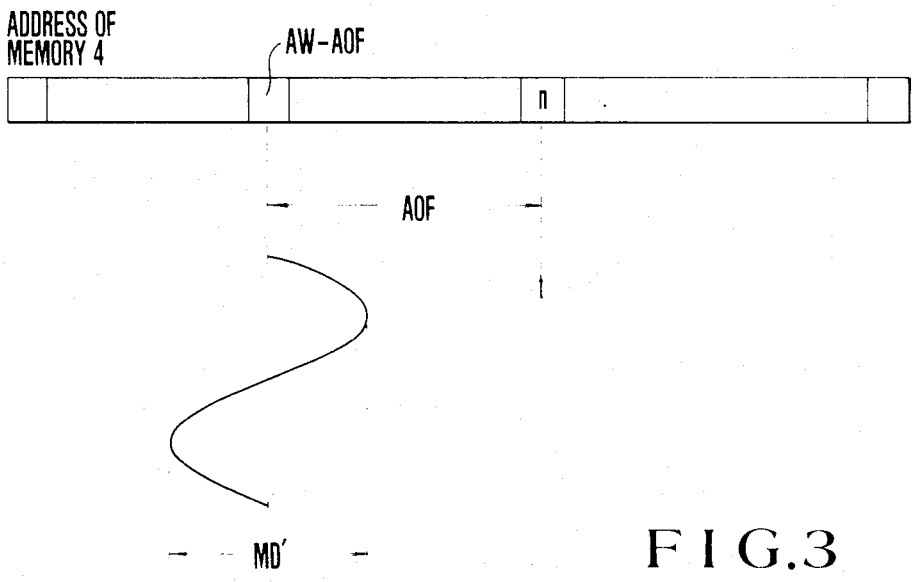
FIG.3

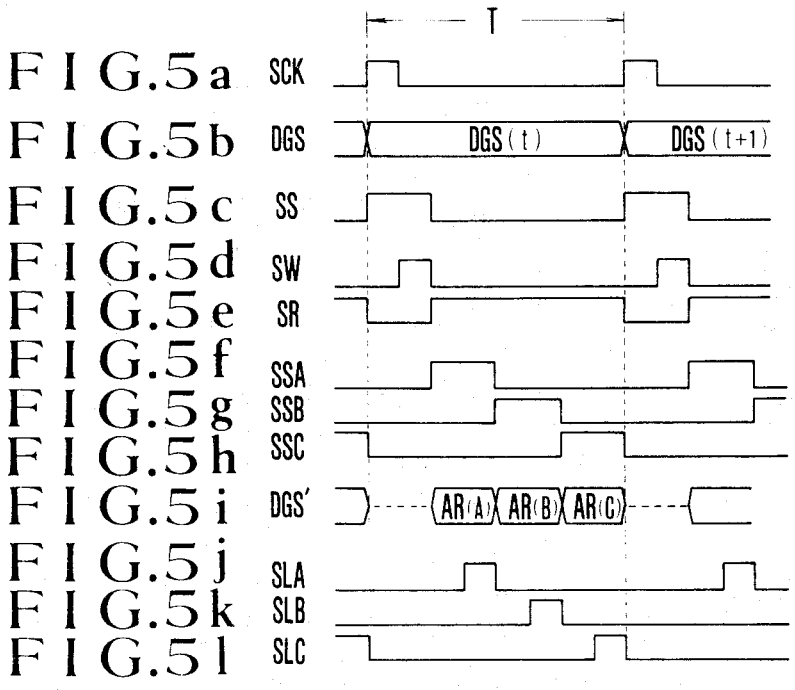
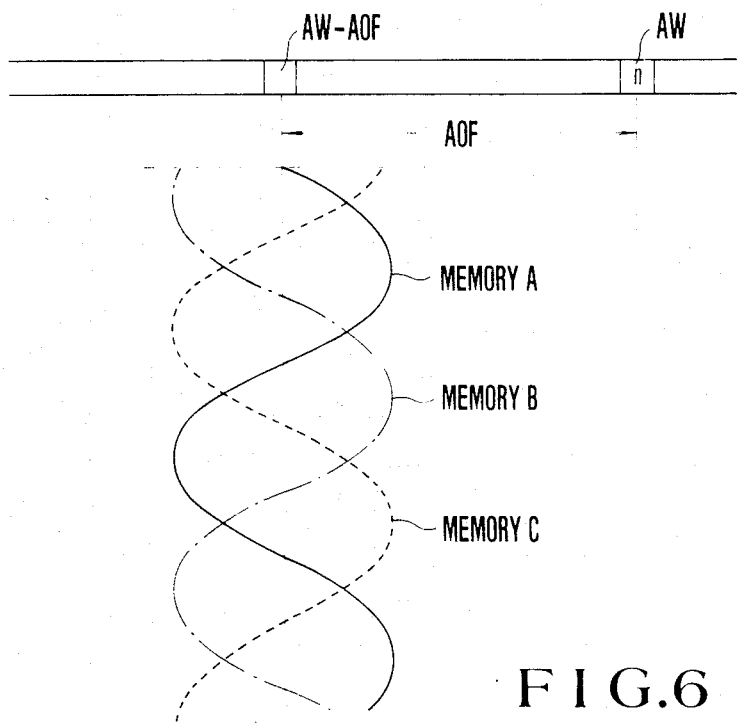
FIG.6

MODULATION EFFECT DEVICE FOR USE IN ELECTRONIC MUSICAL INSTRUMENT

This is a continuation of application Ser. No. 449,298, filed Dec. 13, 1982.

BACKGROUND OF THE INVENTION

This invention relates to a modulation effect device of an electronic musical instrument.

In a prior art modulation effect device for imparting such a modulation effect as vibrato, chorus, ensemble (symphonic chorus) or the like, such analog delay elements as a bucket brigade device (BBD) and charge coupled device (CCD) have been used so as to produce a phase- or frequency-modulated signal from the delay elements by modulating the shift clock signal of the delay elements.

However, in a modulation effect device utilizing such analog delay elements, as the dynamic range with reference to an input signal to the analog delay element is narrow, S/N ratio is low thus resulting in a large noise.

To use a modulation effect device for an electronic musical instrument in which musical tone signals are converted into digital codes, the digital musical tone signals are first converted into analog signals by a D/A converter and then applied to the modulation effect device. It is necessary to use a filter having a sharp cut-off characteristic which makes it difficult to fabricate the filter in an integrated circuit, thus increasing the size.

SUMMARY OF THE INVENTION

It is, therefore, an object of the present invention to provide an improved modulation effect device having an improved S/N ratio which can be readily fabricated as an integrated circuit.

Briefly stated, the modulation effect device of the present invention utilizes a digital memory device storing digitized musical tone signals as a digital modulation circuit.

An address information of the digital memory device is formed by modulation coefficient generating means. This generating means modulates an address information utilized to write or read out the musical tone signal from the digital memory device, in accordance with a given modulation information, thereby imparting a modulation effect to the musical tone signal read out from the memory device.

According to another object of the present invention invention, there is provided a modulation effect device for use in an electronic musical instrument including musical tone signal generating means for generating a musical tone signal in the form of a digitally coded signal, digital modulation means including a digital memory device for storing the coded musical tone signal, and modulation coefficient generating means for supplying a modulated address information to the digital memory device to send out a modulated musical tone signal.

BRIEF DESCRIPTION OF THE DRAWINGS

In the accompanying drawings:

FIGS. 2A–2G are a timing chart useful in explaining the operation of the embodiment shown in FIG. 1;

FIG. 3 shows variations of read addresses of a digital memory device;

FIGS. 5A–5L are a timing chart useful in explaining the operation of the modified embodiment shown in FIG. 4;

FIG. 6 shows waveforms corresponding to FIG. 3 and variations of the read out addresses of the digital memory device;

DESCRIPTION OF THE PREFERRED EMBODIMENT

Figure 1:
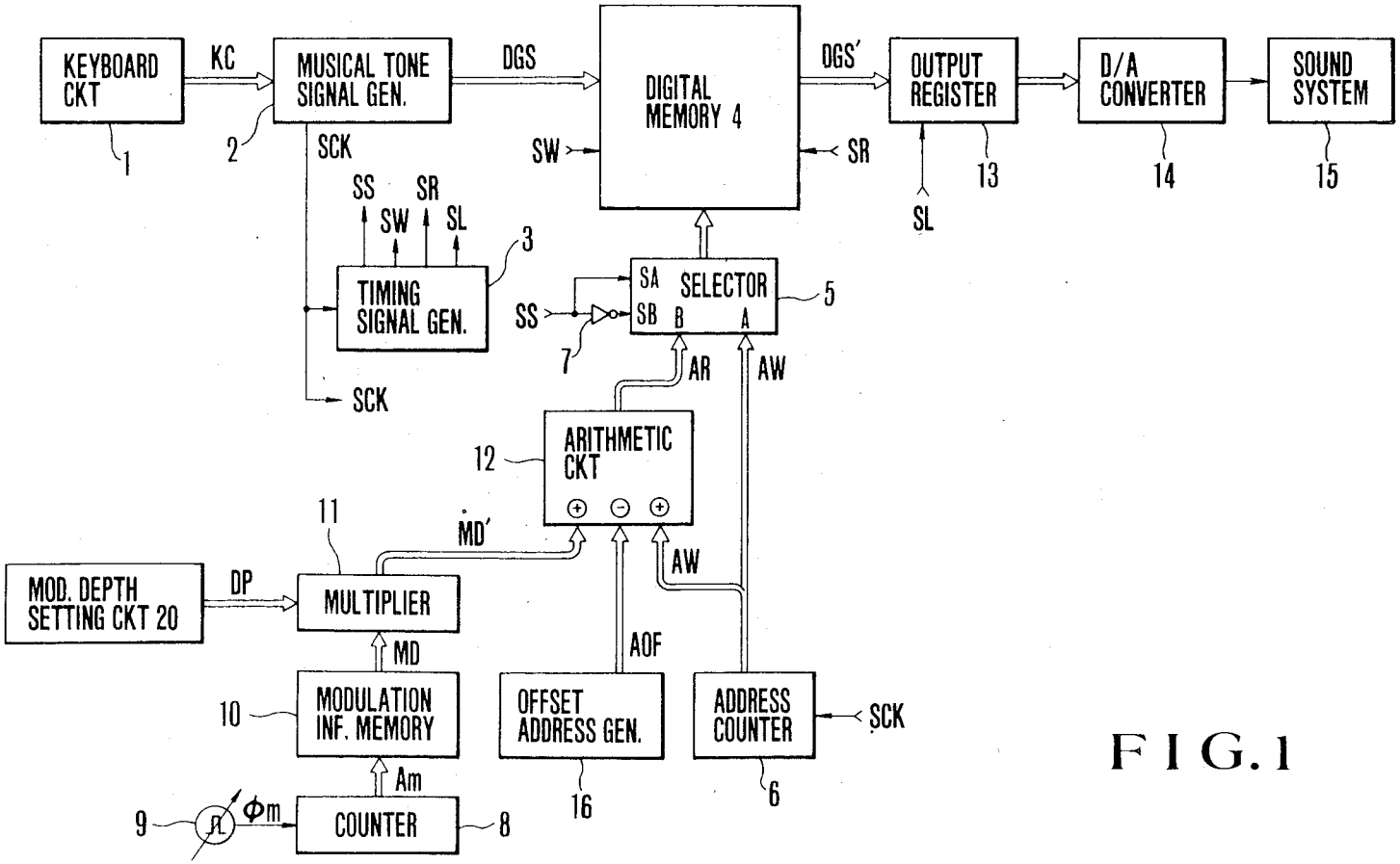
FIG. 1 is a block diagram showing one embodiment of the electronic musical instrument according to the present invention.

In the block diagram shown in FIG. 1, a keyboard circuit 1 includes a plurality of key switches (not shown) corresponding to respective keys of a keyboard, the key switches being operated when associated keys are depressed. The operated key switch produces a key code KC representing the pitch of the depressed key.

In response to a key code KC output by the keyboard circuit 1, a musical tone signal generating circuit 2 forms and outputs a digital musical tone signal DGS corresponding to the pitch of the depressed key. The musical tone signal generating circuit 2 may consist of a harmonic synthesizing system, frequency (amplitude) modulation system or waveform memory read out system as is will known in the art.

The musical tone signal generating circuit 2 forms and outputs digital musical tone signals DGS(t), DGS(t+1). . . , as shown in FIG. *2b*, at respective sampling points of a desired musical tone waveform according to sampling clock signals SCK having a predetermined period T shown in FIG. *2a*, as well as the sampling clock signals.

The sampling clock signals SCK are supplied to a timing signal generator 3. The timing signal generator 3 then forms and outputs a selection control signal SS, a write mode signal SW, a read mode signal SR, and a latch control signal SL as shown in FIGS. *2a* through *2g* based on each of the sampling clock signals SCK.

The digital musical tone signals DGS are supplied to a digital memory device 4 to be sequentially written into its addresses by an address information AW supplied from an address counter 6 via a selector 5 during the first half of one period T of the sampling clock signal. The digital memory device 4 typically includes a random access memory and functions as a digital modulation circuit as described later in detail.

The digital modulation circuit is driven by addressing the digital memory device 4 by using the following components. That is, the address counter 6 counts the number of the sampling clock signals SCK output from the musical tone signal generating circuit 2 and outputs its count as an address information AW varying in synchronism with the speed of forming the digital musical tone signal DGS (that is in synchronism with the period of generation of the signal SCK). The address information AW is applied to the selection input A of the selector 5.

When the selection control signal SS supplied to the selection control input SA of the selector 5 is "1", the selector 5 selects the address information AW supplied to the selection input A, whereas, when the selection control signal SS is "0" a signal "1" is obtained at the output of an inverter 7 by inverting it with the inverter 7, and then the "1" signal is input to a selection control input SB of the selector 5. The selector 5 selects the address information AR applied to the selection input B for reading out a musical tone signal. These selected signals AR or AW are supplied to the address input of the digital memory device 4. As shown in FIG. 2*c*, the selection control signal SS becomes "1" during the first half of one period T of the sampling clock signal SCK whereas it becomes "0" during the latter half.

Consequently, during the first fore half of one period T of the sampling clock signal SCK, that is in the write mode, the selector 5 selects the address information AW and applies the selected address information AW to the address input terminal of the digital memory device 4. At this time, a write mode signal SW is applied to the digital memory device 4 at a timing as shown in FIG. 2*e*. Accordingly, the musical tone signals DGS sequentially formed in the musical tone signals generating circuit 2 according to the sampling clock signal SCK are sequentially written into the addresses designated by the address information AW in the first fore half of one period T of the sampling clock signal SCK.

The musical tone signals DGS thus written are read out in the following manner according to the address information AR formed corresponding to a desired modulation effect.

More particularly, a counter 8 sequentially counts the number of clock signals $\phi m$ having a period corresponding to the modulation speed of a desired modulation effect and generated by a variable frequency type oscillator 9 and supplies its count to a modulation information memory device 10 as an address information Am.

The modulation information memory device 10 is prestored with sine amplitude values at respective sampling points of one period of a sine waveform, for example, corresponding to the desired modulation effect. Thus, each time an address information Am is applied from the counter 8, the sine amplitude values at respective sampling points are sequentially read out from the modulation information memory device 10. The read out amplitude values are applied to a multiplier 11 as modulation informations MD. Since the address information Am output from the counter 8 varies with time at a repetition period corresponding to the desired modulation effect speed, the modulation information MD output from the modulation information memory device 10 also varies with a repetition period corresponding to the desired modulation effect speed.

The purpose of the multiplier 11 is to control the modulation depth of the desired modulation effect and to multiply a modulation information MD with a modulation depth information DP supplied from a modulation depth setting circuit 20 so as to produce the product as a modulation information MD' with its modulation depth controlled.

The modulation information MD' is supplied to an addition input ⊕ of an arithmetic circuit 12 as an information for modulating the address information AW output from the address counter 6.

The purpose of the arithmetic circuit 12 is to form an address signal AR for reading out a digital musical tone signal DGS(t−K), a K time before the present time t, in accordance with a desired modulation effect, among digital musical tone signals DGS which have been sequentially written into the digital memory device 4. The address information AW is applied to a second addition input ⊕ of the arithmetic circuit 12 from the address counter 6, while an offset address information AOF is applied to a subtraction input ⊖ from an offset address information generator 16.

When these informations are input, the arithmetic circuit 12 produces an address information AR by carrying out an arithmetic operation shown by the following equation $$AR=AW-AOF+MD' \quad (1)$$

The offset address information AOF is given as a constant corresponding to the desired modulation effect.

Accordingly, in the example illustrated in FIG. 3, the arithmetic circuit 12 forms an address information varying, by a value shown by the information MD', around an address AW-AOF which is apart from an address n corresponding to the address signal AW at the present time by a value shown by an information AOF. Thus, the arithmetic circuit 12 modulates the address information AW with informations AOF and MD' to form an address signal AR for reading out the musical tone signals.

The address signal AR is selected by the selector 5 during the latter half of one period T of the sampling clock signal SCK to be supplied to the address input of the digital memory device 4. At this time, a readout mode signal SR is applied to the digital memory device 4 at a timing as shown by FIG. 2*f*.

Consequently, a digital musical tone signal DGS, i.e., DGS(t−K), stored in an address designated by the address information $AR$ ($=AW-AOF+MD'$) is read out from the digital memory device 4. Denoting the time as K, in which the information AW reaches an address value set apart by a value represented by AOF and MD', a digital musical tone signal DGS(t−K) which has been written before the time K would be read out at the present time t. As a consequence, it is possible to obtain a musical tone signal DGS' equivalent to that obtained by phase- or frequency-modulating the digital musical tone signal DGS.

The digital musical tone signal DGS' thus obtained is supplied to an output register 13 and latched therein by a latch control signal SL produced at a timing as shown in FIG. 2*g*. Then, the digital musical tone signal is converted into an analog musical tone signal by a D/A converter 14 and produced as a musical tone through a sound system 15.

As a consequence, various modulation effects can readily be provided by setting the offset address information AOF in accordance with an average time delay of a musical tone imparted with a modulation effect and by varying with time the information MD' corresponding to the desired modulation effect.

Although in the preferred embodiment, a modulation information MD was changed according to a sine waveform, it will be apparent to those skilled in the art that such change may be effected through the use of an appropriate waveform such as rectangular wave, a saw tooth wave or a cycloid wave.

The operation carried out by the arithmetic circuit 12 may alternatively be such as one expressed by $AR=AW+AOF+MD'$.

To obtain the modulation information MD, instead of sampling a predetermined waveform and storing the amplitude values as described above, an accumulator may be used, in which case the value or the input thereof is added or subtracted to obtain the waveform described above.

A plurality of parallel modulation circuits may be provided for modulating the address signal of the digital memory device for simultaneously producing musical tones imparted with a plurality of modulation effects so as to obtain an ensemble effect. Such an example is shown in FIG. 4.

Figure 4:
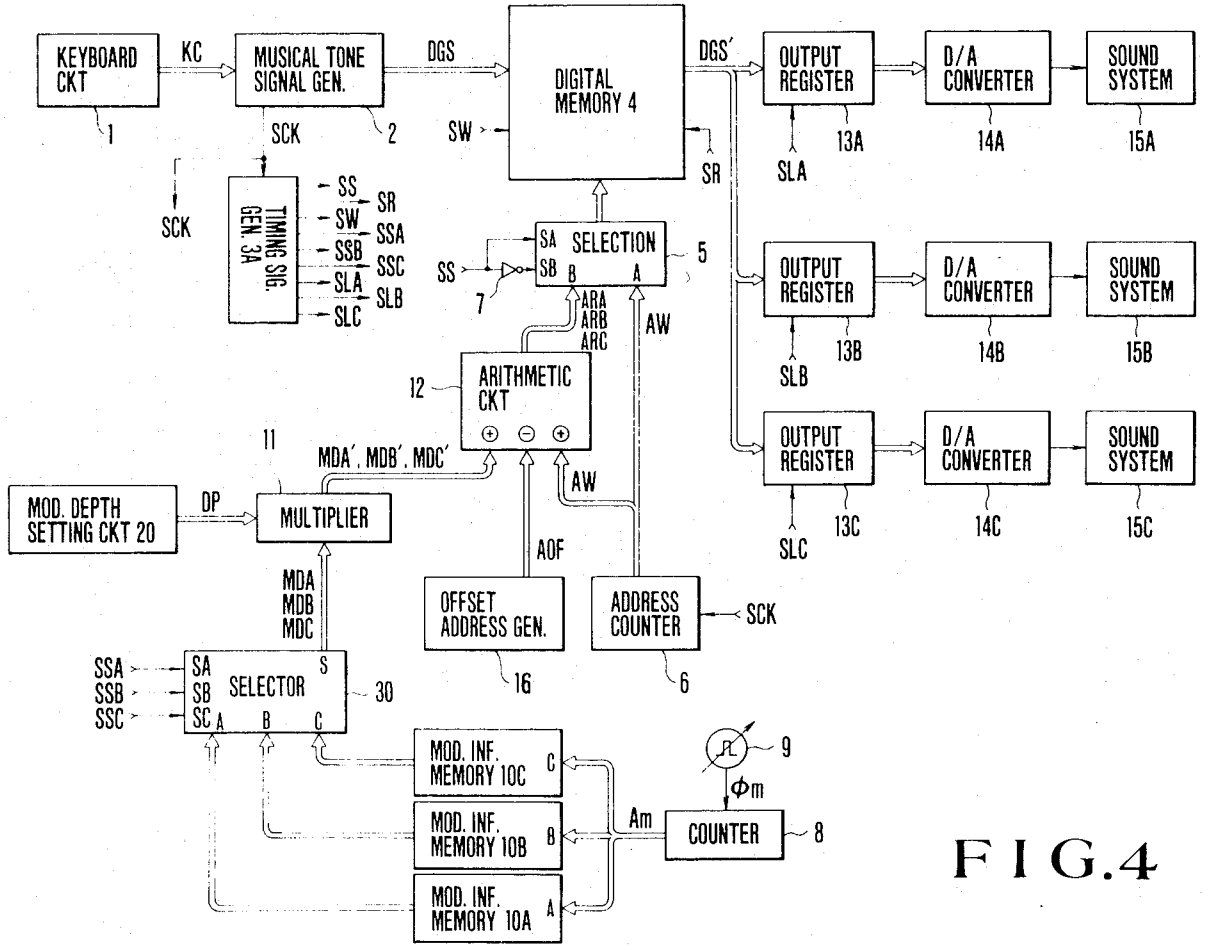
FIG. 4 is a block diagram showing a modified embodiment of this invention utilizing a plurality of parallel modulation circuits for providing an ensemble effect.

In FIG. 4, circuit elements identical to those shown in FIG. 1 are designated by the same reference numeral. The output of the counter 8 is supplied to three parallelly connected modulation information memory devices 10A, 10B and 10C as an address information Am. Each of these modulation memory devices is storing a sampling amplitude value of a suitable waveform such as a sine wave, triangular wave or tooth saw wave, etc., as described above. These modulation memory devices may store the same or different waveforms.

The outputs of these modulation memory devices 10A, 10B and 10C are applied to inputs A, B and C of a selector 30, respectively. Control signals SSA, SSB and SSC are applied to the control input terminals SA, SB and SC respectively of the selector 30 from a timing signal generator 3A so as to supply to a multiplier 11 the outputs of the modulation information memory devices 10A, 10B and 10C. The control signals SSA, SSB and SSC supplied to the selector 30 are generated by the timing signal generator 3A based on a sampling clock signal SCK (FIG. 5A) sent from the musical tone signal generator 2. The timings of generation of these control signals are shown in FIGS. 5*f*, 5*g* and 5*h*. As illustrated in these drawings, the control signals SSA, SSB and SSC are sequentially generated with a predetermined order in the latter period of the sampling clock signal SCK after generation thereof. As the control signal SSA is supplied, the output of the modulation information memory device 10A supplied to input A is selected and supplied to the multiplier 11 as an output MDA. Where the control inputs are SSB and SSC, respectively, the outputs of the modulation information memory devices 10B and 10C are supplied to the multiplier 11 as outputs MDB and MDC, respectively. In the same manner as in the embodiment shown in FIG. 1, the multiplier 11 multiplies the modulation depth information DP given from a modulation depth setter 20 to modulation informations MDA, MDB and MDC sequentially output from the selector 30 to send products MDA', MDB' and MDC' to the arithmetic circuit 12.

In the same manner as in FIG. 1, in addition to the products MDA', MDB' and MDC', the arithmetic circuit 12 is supplied with an address information AW from the address counter 6 and an offset address information ADF from the offset address information generator 16. Accordingly, the arithmetic circuit 12 processes the applied products according to equation (1) described above to produce address informations ARA, ARB and ARC for reading out musical tone signals from the digital memory device 4. These address informations are sequentially supplied to an input terminal B of the selector 5.

A selector control signal SS is applied to the control input terminal SA of the selector 5 from the timing signal generator 3A at a timing shown in FIG. 5*c*. While being supplied with the control signal SS, the selector 5 applies to the digital memory device an address information AW supplied to the control input terminal SB from the address counter 6 to store a digital musical tone signal DGS in an address of the digital memory device 4 designated by an address information AW according to the timing action of a write designation signal SW shown in FIG. 5*d*. When the supply of the selector control signal SS is stopped, the output of an inverter 7 is supplied to the selector control input terminal SB to sequentially send to the digital memory device 4 the musical tone signal read out address informations ARA, ARB and ARC output from the arithmetic circuit 12. When the digital memory device 4 receives the readout designation signal SR at a timing as shown in FIG. 5*e*, the mode of the digital memory device 4 is changed to a musical tone signal read out mode, thereby reading out musical tone signals DGS' stored in respective addresses in accordance with the readout address informations ARA, ARB and ARC supplied from the arithmetic circuit 12 via the selector 5.

FIG. 6 corresponds to FIG. 3 and shows the variation in the readout addresses of the digital memory device 4. More particularly, the arithmetic circuit 12 forms address informations ARA, ARB and ARC, varying by values shown by informations MDA', MDB' and MDC', around an address (AW-AOF) apart from an address n designated by an address signal AW at the present time t by a value shown by an information AOF. In other words, the arithmetic circuit 12 modulates the address information AW with informations AOF, MDA', MDB' and MDC' to sequentially output address signals ARA, ARB and ARC for reading out musical tone signals.

These address signals ARA, ARB and ARC are selected by the selector 5 in the latter portion of one period T of the sampling clock signal SCK and supplied to address inputs to the digital memory device 4. At this time, the digital memory device 4 is supplied with a readout designation signal SR at a timing as shown in FIG. 5*e* thus changed into readout mode.

As a consequence, the digital musical tone signals DGS, that is DGS(t−K) stored at the addresses designated by the address informations ARA, ARB and ARC, are read out from the digital memory device 4 at the timings as shown in FIGS. 5*f* through 5*h*. As shown in FIG. 5*i*, denoting the timing required for the information AW, for example, to reach address values separated by AOF and MDA' by K, a digital musical tone signal DGS(t−K) written before K time would be read out at the present time t. As a consequence, three musical tone signals DGS' can be obtained which are equivalent to those obtained by phase- or frequency-modulating the digital musical tone signals DGS.

The digital musical tone signals DGS' thus formed are simultaneously supplied to output registers 13A, 13B and 13C. However, since the output registers are independently supplied with latch control signals SLA, SLB and SLC generated at the timings shown in FIGS. 5*j* through 5*l*, they latch the memory outputs sent out when the output registers are supplied with corresponding latch control signals. The outputs of the output registers 13A, 13B and 13C are converted into analog musical tone signals by D/A converters 14A, 14B and 14C and produced by sound systems 15A, 15B and 15C as audible musical tones.

As the content of the digital memory device 4 is read out in accordance with the address information ARA, ARB and ARC the output DGS' of the digital memory device 4 is supplied to the output registers 13A, 13B and 13C which latch the memory output DGS' when they are supplied with latch control signals SLA, SLB and SLC synchronous with the selector control signals SSA, SSB and SSC respectively. The outputs of the registers 13A, 13B and 13C are applied to sound systems 15A, 15B and 15C, respectively through D/A converters 14A, 14B and 14C so as to produce musical tones imparted with independent modulation effects.

Figure 7:
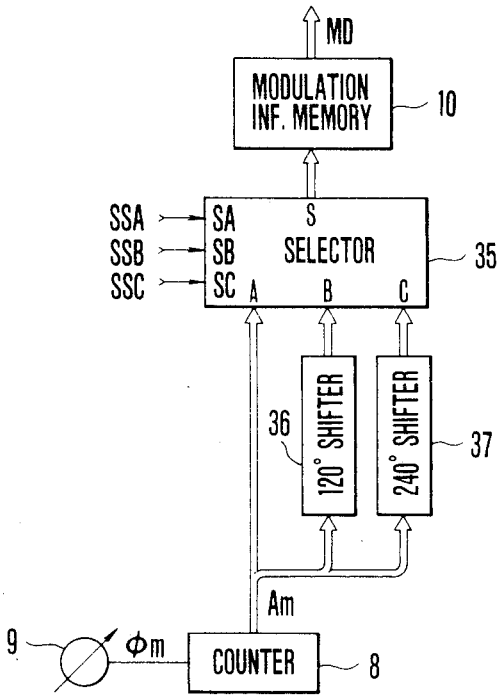
FIG. 7 is a partial block diagram showing a modification of the embodiment shown in FIG. 4.

FIG. 7 is a partial block diagram showing a modification of the embodiment shown in FIG. 4 in which, for the purpose of forming a plurality of readout address informations, three modulation information memory devices 10A, 10B and 10C, shown in FIG. 4, are replaced by a single modulation information memory device 10. Three address informations Am are provided for the modulation information memory device 10 for reading out the content thereof on the time division basis. Where an information is read out from the modulation information memory device 10 the information is processed such that signals dephased by 0°, 120° and 240° are obtained with respect to the address information supplied from the counter 8. For this purpose, there are provided a selector 35, a 120° phase shifter 36 and a 240° phase shifter 37. The address information Am output from the counter 8 is applied directly to the input terminal A of the selector 35 and to input terminals B and C, respectively, through the 120° phase shifter 36 and through the 240° phase shifter 37. The selector 35 is identical to the selector 30 shown in FIG. 4 and supplied with three sector control signals SSA, SSB and SSC generated at the timings shown in FIGS. 5*f*, 5*g* and 5*h*.

With this modification, three modulation informations MDA, MDB and MDC, dephased 120° with each other, can be obtained from the modulation information memory device 10.

Figure 8:
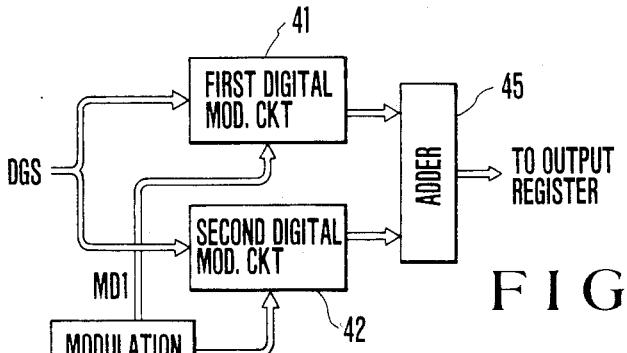
FIGS. 8, 9 and 10 are partial block diagrams showing still further modifications of this invention.
Figure 9:
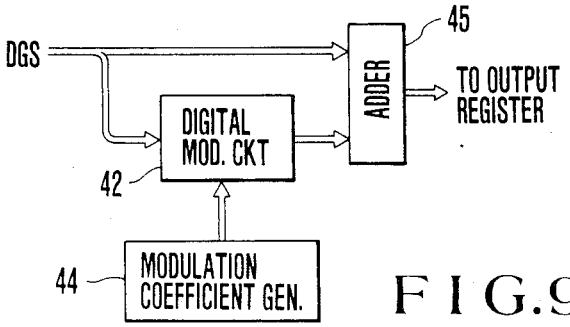
Figure 10:
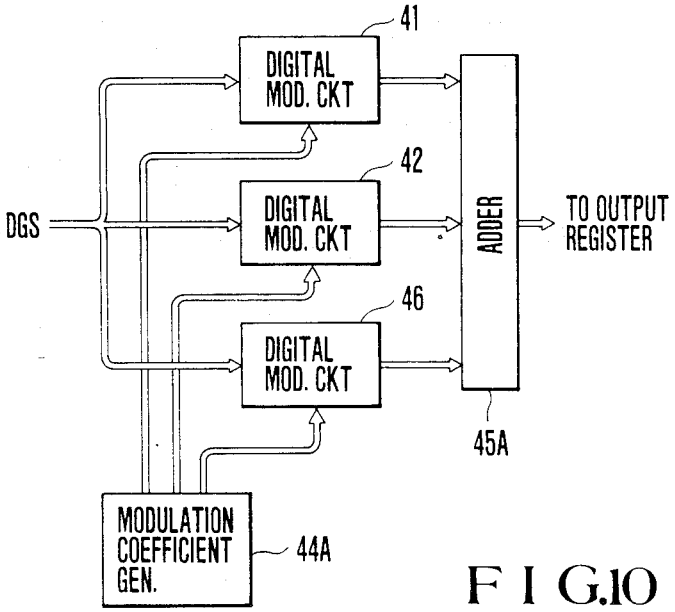

FIGS. 8, 9 and 10 show still further modifications of the present invention in which a plurality of musical tone signal generating circuits are provided.

In FIG. 8, a musical tone signal DGS sent from the musical tone signal generator 2 is applied to digital modulation circuits 41 and 42 which include parallelly connected first and second digital memory devices. These modulation circuits 41 and 42 modulate the musical tone signal DGS with different modulation coefficients MD1 and MD2 given from a modulation coefficient generator 44. The coefficients MD1 and MD2 correspond to the digital memory readout address informations described in the previous embodiment. Thus, the method of preparing the coefficients will not be repeated. The outputs of the modulation circuits 41 and 42 are added together by an adder 45 and then produced as audible musical tones via an output register, a D/A converter and a sound system.

In the modification shown in FIG. 9, the output DGS of the musical tone signal generator 2 is applied directly to the adder 45 without passing through modulation circuits as in FIG. 8. A portion of the output DGS is sent to a digital modulation circuit 42 including a digital memory device to be modulated by the modulation coefficient generated by the modulation coefficient generator 44, whereby a modulated musical tone signal is sent to the adder 45.

In the modification shown in FIG. 10, three modulation circuits, each of which corresponds to the modulation circuit shown in FIG. 8, are provided. A musical tone signal DGS sent from the musical tone signal generator 2 is applied to three digital modulation circuits 41, 42 and 46. These digital modulation circuits 41, 42 and 46 modulate the musical tone signal DGS with different modulation coefficients which are respectively sent from a modulation coefficient generator 44A. The outputs of the digital modulation circuits 41, 42 and 46 are applied to an adder for synthesizing them.

It should be understood that the present invention is not limited to the specific embodiment described above and that many changes and modifications will be obvious to one skilled in the art.

For example, in the embodiment shown in FIG. 4, although the output DGS' of the digital memory device was processed to produce a musical tone, on the spaced division basis, with three parallelly connected tone producing channels, it is also possible to synthesize the outputs of two or more channels by means of an adder to reduce the number of sound systems.

Furthermore, although in the foregoing embodiments the address informations for reading out the contents of the digital memory device 4 were modulated, the write address informations for writing data into the digital memory device 4 can instead be modulated. Circuits for modulating the write address informations are similar to those utilized to modulate the readout address informations so that it is only necessary to exchange the write circuit and the readout circuit. Accordingly, it is considered unnecessary to describe in detail a modification.

In the foregoing embodiment a microcomputer may be used for constructing a circuit which operates in the same manner. The microcomputer may be of a general purpose type and need not be substantially modified for use in this invention.

As a clock signal for reading out the modulation information, a signal obtained by frequency dividing the sampling clock signal SCK may be used.

It is also possible to reverse the order of writing and reading of the digital memory device 4 so as to read out during the first half of one period T and to write during the latter half.

As described above, the modulation effect device of this invention includes modulation information generating means which generate a modulation information which varies with time in accordance with a desired modulation effect, and an address counter which generates an address information varying with time at a predetermined speed. Digitalized musical tone signals are sequentially stored in addresses of a digital memory device, and a musical tone signal stored in an address represented by the difference between the address information and the modulation information is read out. The readout musical tone signal is then phase- or frequency-modulated in accordance with the modulation information.

It is, therefore, possible to readily obtain a modulation effect of improved S/N ratio. Furthermore, the circuit can be formed as an integrated circuit, thus decreasing the size. Accordingly, the modulation effect device of this invention can be advantageously used in an electronic musical instrument.

It will be appreciated by those skilled in the art that many variations and modifications may be made to the present invention without departing from the spirit thereof. Such modifications and variations are included within the intended scope of the claims appended hereto.

What is claimed is:

1. A modulation effect device for use in an electronic musical instrument comprising:

digital tone signal generator means for generating a digitally coded musical tone signal in response to a signal having a value variable with the frequency of the generated musical tone;

digital memory means having a read mode and a write mode for storing said digitally coded musical tone signal;

address information means for sequentially generating original address information in synchronization with the generation of said musical tone signal, said original address information specifying an address in said digital memory means where the corresponding wave shape data of said musical tone signal is to be stored during the write mode of said digital memory means;

modulation information generating means for generating a modulation information which varies in accordance with a predetermined function with time;

means for generating an offset information to offset said original address information a predetermined number of addresses in said digital memory means;

modulator means for combining said modulation information, said offset information, and said original address information to generate a modulated address information which varies timewise in accordance with said modulation information about an address information displaced from said original address information by said predetermined number of addresses corresponding to the value of said offset information, said modulated address information specifying an address in said digital memory means to read out the stored musical tone signal in the read mode of said digital memory means;

means for alternatively generating write and read mode signals controlling the write and read modes of said digital memory means; and control means for selectively applying to said digital memory means said original address information when said digital memory means is in said write mode to store said musical tone signal in said digital memory means and for applying to said digital memory means said modulated address information when said digital memory means is in said read mode to output said musical tone signal from said digital memory means.

2. The modulation effect device of claim 1 further comprising:

means for generating a modulation depth information to control the magnitude of said modulation information; and multiplier means for multiplying said modulation information with said modulation depth information to modify the depth of said modulation information applied to said modulator means.

3. The modulation effect device of claim 1 wherein said modulation information generating means comprises:

a plurality of modulation information memories storing different modulation information;

an address signal generator for generating an address accessing the modulation information stored in said plurality of modulation information memories to output a plurality of modulation informations; and selector means for selectively applying said plurality of modulation informations to said modulator means.

4. The modulation effect device of claim 3 wherein said means for alternatively generating write and read mode signals further comprises means for generating signals coordinating the operation of said selector means, said modulator means, said digital memory means and said control means to apply said modulation informations to said digital memory means with a time division timing, said modulation effect device further comprising a plurality of latching means for latching, at said time division timing, said musical tone signals read out from said digital memory means, each latching means corresponding to a different one of said plurality of different modulation informations.

5. The modulation effect device of claim 1 wherein said modulation information generating means comprises:

a waveform memory device for storing waveform information;

an addressor generator for generating original address signals successively accessing said waveform information; and means for shifting said original address signals by a predetermined value to form at least one group of phase shifted address signals having a phase different from said original address signals so that said stored waveform information is successively accessed from said waveform memory device by said original address signals and said phase shifted address signals to generate at least two different modulation informations.

6. A modulation effect device for use in an electronic musical instrument comprising:

digital tone signal generator means for generating a digitally coded musical tone signal in response to a signal having a value variable with the frequency of the generated musical tone;

digital modulation means comprising a plurality of digital memory means connected in parallel, each of said plurality of digital memory means storing said musical tone signal in a predetermined order and operative to be accessed to read out said stored musical tone signal;

address information means for generating original address information in synchronization with the generation of said digital musical tone signal which progresses timewise and which specifies an address in each of said plurality of digital memory means where the wave shape data of said musical tone signal is to be stored;

modulation coefficient generating means for generating a plurality of different modulated address informations each of which vary in accordance with a different predetermined function with time, each of said modulated address informations accessing one of said plurality of digital memory means to read out said stored musical tone signals in an order different from said predetermined order in which they were generated and stored in said plurality of digital memory means; and means for adding together said musical tone signals read out from said plurality of digital memory means to generate a modulated tone signal modulated in accordance with said modulated address information.

7. A modulation effect device for use in an electronic musical instrument comprising:

digital tone signal generator means for generating a digitally coded musical tone signal in response to a signal having a value variable with the frequency of the generated musical tone;

digital modulation means comprising a digital memory means for storing said digitally coded musical signals in a predetermined order and operative to be accessed to read out said stored musical tone signal;

address information means for generating original address information, in synchronization with the generation of said digitally coded musical signals, which progresses timewise and which specifies an address in said digital memory means where the wave shape data of said musical tone signal is to be stored;

modulation coefficient generating means for generating a modulated address information which varies in accordance with a predetermined function with time to access said digital memory means and read out said stored digitally coded musical signals in an order different from said predetermined order in which they were generated and stored in said digital memory means; and means for adding said digitally coded musical signals generated by said musical tone generating means and said digitally coded musical signals read out from said digital memory means to generate a modulated musical tone signal modulated in accordance with said modulated address information.

8. A modulation effect device for use in an electronic musical instrument comprising:

digital tone signal generator means for generating a digitally coded musical tone signal in response to a signal having a value variable with the frequency of the generated musical tone;

digital memory means having a read mode and a write mode for storing the digitally coded musical tone signal;

address information means for generating original address information which progresses timewise and which specifies an address in said digital memory means where the wave shape data of said musical tone signal is to be stored during the write mode of said digital memory means;

modulation information generating means for generating a modulation information which varies in accordance with a predetermined function with time;

modulation means for modulating said original address information by said modulation information to generate modulated address information which varies timewise in accordance with said modulation information, said modulated address information specifying an address in said digital memory means to read out the stored digitally coded musical tone signal in said read mode of said digital memory means;

means for alternatively generating write and read mode signals for controlling the write and read modes of said digital memory means;

control means for selectively applying to said digital memory means said original address information when said digital memory means is in said write mode to store said musical tone signal in said digital memory means and for applying to said digital memory means said modulated address information when said digital memory means is in said read mode to output said musical tone signal from said digital memory means; and means for synchronizing the generation of said original address information with the generation of said musical tone signal.

* * * * *

UNITED STATES PATENT AND TRADEMARK OFFICE

CERTIFICATE OF CORRECTION

PATENT NO. : 4,569,268

DATED : February 11, 1986

INVENTOR(S) : Tsuyoshi Futamase, et al.

It is certified that error appears in the above-identified patent and that said Letters Patent is hereby corrected as shown below:

Column 3, line 12, delete "fore".

Column 3, line 23, delete "fore".

Signed and Sealed this

*First* Day of *July 1986*

[SEAL]

*Attest:*

DONALD J. QUIGG

*Attesting Officer*

*Commissioner of Patents and Trademarks*